United States Patent [19]

Nigrelli, Sr.

[11] Patent Number: 4,685,275

[45] Date of Patent: Aug. 11, 1987

[54] CARTON OPENING APPARATUS

[76] Inventor: Biagio J. Nigrelli, Sr., 14829 Moraine Rd., Kiel, Wis. 53042

[21] Appl. No.: 872,912

[22] Filed: Jun. 11, 1986

[51] Int. Cl.[4] ..... B65B 43/34

[52] U.S. Cl. ..... 53/458; 53/566; 493/319

[58] Field of Search ..... 53/566, 564, 458; 493/319, 318, 309, 183

[56] References Cited

U.S. PATENT DOCUMENTS

| | | | |
|---|---|---|---|
| 2,989,903 | 6/1961 | Wilcox | 493/319 |
| 3,016,808 | 1/1962 | Galloway | 493/319 |
| 3,060,659 | 10/1962 | Blais et al. | 53/566 |
| 3,080,797 | 3/1963 | Cook | 493/319 |
| 3,097,463 | 7/1963 | Neal et al. | 53/566 |
| 3,300,946 | 1/1967 | Martin | 53/566 X |
| 4,067,172 | 1/1978 | Paules | 53/566 X |
| 4,081,945 | 4/1978 | Calvert et al. | 53/566 |
| 4,358,918 | 11/1982 | Groom et al. | 53/566 X |

*Primary Examiner*—James F. Coan

*Attorney, Agent, or Firm*—Fuller, Puerner & Hohenfeldt

[57] ABSTRACT

Apparatus is provided for opening folded open side carton blanks. The apparatus includes a first conveyor system for stripping blanks from a supply thereof at a first speed and for propelling the blanks downstream to a second conveyor system operating at a second speed greater than the first speed to accelerate the blanks and propel them to an unfolding station. The carton lower layer flaps are bent angularly downward. A pair of paddles having inclined leading edges rotate in horizontal planes to penetrate the space between the carton upper and lower layers and to lift the upper layer above the lower layer. The paddles also have bottom surfaces for holding the blank lower layer downwardly. The paddle tips travel at a faster speed than the second conveyor, so the tips slide forwardly to contact and push the blank leading panel forwardly to further unfold the flank. Simultaneously with the rotation of the paddles, a pocket conveyor positions a first flight bar to control the blank leading edge while the blank is undergoing the lifting and pushing by the paddles. A second flight bar on the pocket conveyor is positioned and is operated such that it contacts the trailing of the partially opened blank for propelling the blank leading edge against the first flight bar, thereby propelling the blank into a fully opened condition. The first and second flight bars may be on separate conveyors to thereby facilitate apparatus changeover to accommodate different size cartons. The apparatus further includes pusher means for continuously side loading articles into the cartons while imparting longitudinal motion to the articles.

14 Claims, 13 Drawing Figures

CARTON OPENING APPARATUS

BACKGROUND OF THE INVENTION

1. Field of the Invention

This invention pertains to carton unfolding apparatus, and more particularly to apparatus for unfolding open side carton blanks.

2. Description of the Prior Art

Various equipment has been developed to unfold open side carton blanks. The unfolding machinery is often integrated with other apparatus that operates on a continuous basis to open the blanks, load the cartons from one or both sides with the items to be shipped in the cartons, and closing and sealing the loaded cartons.

The folded blanks are usually supplied to the unfolding equipment from a storage hopper in which the blanks are stacked vertically in a pile. Suitable mechanisms are employed to remove the blanks one at a time from the hopper and to deposit them at the first station in the unfolding machinery.

Examples of carton unfolding apparatus are disclosed in U.S. Pat. Nos. 3,060,659; 3,097,463; 3,300,946; 4,067,172; 4,081,945; and 4,358,918. The equipment shown in the foregoing patents are generally quite complicated, and therefore are undesirably expensive and unreliable. Other carton unfolding machinery, such as disclosed in U.S. patent application Ser. No. 602,527 is generally satisfactory for most applications. However specific operating conditions occasionally arise that preclude using prior unfolding devices. In those situations, a need exists for a carton blank unfolding machine that satisfies the specific application in a reliable and economical manner.

SUMMARY OF THE INVENTION

In accordance with the present invention, economical high speed machinery is provided that opens folded side loading carton blanks on a reliable basis. This is accomplished by apparatus that includes a pair of expansion arms that rotate to enter the opposite open ends of the blank in the space between the blank upper and lower layers and to open the blank by erecting the front panel by pulling on the front panel or leading transverse panel. The pulling on the top and leading panel to erect causing vertical erection of the front panel unfolds the parallelogram shaped carton into a fully erected rectangular carton. The action is similar to pulling the front of a rope with the trailing end following and under control.

The flat folded blanks are stripped from a supply hopper and are propelled horizontally downstream along machine rails by a first conveyor system operating at a first speed. A second or accelerator conveyor system is positioned at the downstream end of the first conveyor system. The second conveyor system operates at a faster speed than the first conveyor system. Lugs on the second conveyor system catch up to the trailing edges of the blanks and take over from the first conveyor system to propel the blanks farther downstream to an unfolding station. The lugs on the second conveyor take over and move the blanks from under the horizontal hooks on the lugs of the first conveyor so the first conveyor lugs can separate from the edge of the carton and return beneath the conveyor bed. Prior to the start of the unfolding cycle, conventional plows bend the blank lower layer flaps angularly downwardly. Expansion arms on each side of the blank rotate about respective vertical axes in timed relation to the downstream movement of the blanks as propelled by the accelerator conveyor system. The expansion arms include paddles that are constructed with inclined leading edges and flat bottom surfaces. The paddles are operated to rotate over the blank bent-down lower layer flaps and under the blank horizontal extending upper layer flaps so as to penetrate the small vertical space between the blank upper and lower layers. Such paddle penetration urges the blank upper layer upwardly. Simultaneously, the paddle bottom surfaces slide over and positively restrain the blank lower layer downwardly against the machine rails. Because the paddles positively contact both the blank upper and lower layers during the initial opening process, the paddles are able to break loose any bonding between the upper and lower layers caused by stray glue deposited within the blank during blank manufacture. The expansion arms rotate at a speed that imparts to the paddle tips a peripheral speed greater than the speed of the accelerator conveyor. Consequently, the tips slide forwardly within the blank while also lifting the upper layer off the lower layer. As the expansion arm tips continue to slide forwardly within the blank, they ultimately contact the blank leading panel. Continued rotation of the expansion arms urges the leading panel forwardly relative to the blank leading edge and bottom panel to further unfold the blank.

To control the blank leading edge and to restrain it against forward motion induced by the expansion arm tips, a third or pocket conveyor system is employed. The pocket conveyor system has a series of pairs of leading and trailing flight bars attached to one or more chains that are located below and parallel to the machine rails. The flight bars are spaced such that the distance between the foot ends of the bars of a pair is equal to the width of the carton top and bottom panels. The second and pocket conveyor systems are operated at the same speed. The lugs of the accelerator and pocket conveyor systems are in spaced relation to each other and to the expansion arms such that the foot end of a pocket conveyor leading flight bar is in position to control a blank leading edge just as the expansion arm tips start to penetrate a blank. The result of the cooperation between the second and pocket conveyor system is that the blank leading edge is controlled and restrained by a pocket conveyor leading flight bar as the blank upper layer is pushed upwardly by the expansion arms to begin the unfolding process.

As the blank is undergoing initial unfolding due to the expansion arms, the blank trailing edge rises above the machine rails to a height above the top of the second conveyor system lugs. To continue the downstream propelling process, the third conveyor system trailing flight bars are employed. The trailing flight bars are positioned so as to contact the blank trailing edges near the free ends of the trailing flight bars just as the trailing edge rises above the second conveyor system lugs. The trailing flight bars travel in arcuate paths as they contact and propel the blank trailing edges. Consequently, the trailing flight bars free ends travel at speeds greater than the speeds of their ends fixed to the chains and faster than the blank bottom layer, which is controlled by the leading flight bars. The trailing flight bars thus propel the trailing edge forwardly with respect to the blank leading edge, further unfolding the blank.

To provide the arcuate motion of the pocket conveyor trailing flight bars behind the blank trailing edge, the upstream sprocket on the third conveyor system is located under the unfolding station in a location such that the trailing flight bar is in a position on the side of the sprocket when a blank reaches the unfolding station. At that point, the trailing flight bar extends nearly horizontally under the blank. The third conveyor system sprocket is positioned such that as the blank moves downstream in unison with the foot end of the leading flight bar, the trailing flight bar swings in an arcuate path from the nearly horizontal attitude to a nearly vertical attitude as it approaches the top of the sprocket. The timing of the trailing flight bar and expansion arms is such that the expansion arms rotate out of contact with the partially opened blank before the trailing flight bar attains a nearly vertical attitude. Further motion of the third conveyor system brings the trailing flight bar to a vertical attitude, thereby completing the unfolding operation. The carton is then propelled downstream by the flight bars for filling and closing.

It is a feature of the present invention that the pocket conveyors may employ separate chains and sprockets for the leading and trailing flight bars. The dual chain and sprocket arrangement greatly facilitates changeover to suit different size cartons.

The apparatus of the present invention includes a pusher system for side loading complements of articles into the opened cartons. In the preferred embodiment, the pusher system comprises two pairs of chains and sprockets that straddle and operate at the same speed as the pocket conveyor system. A pusher bar is attached to each pair of chains and sprockets, and a complement of articles is captured between the two pusher bars. Guides direct the articles transversely inwardly into the cartons as the pusher bars push the articles downstream in synchronization with the cartons.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
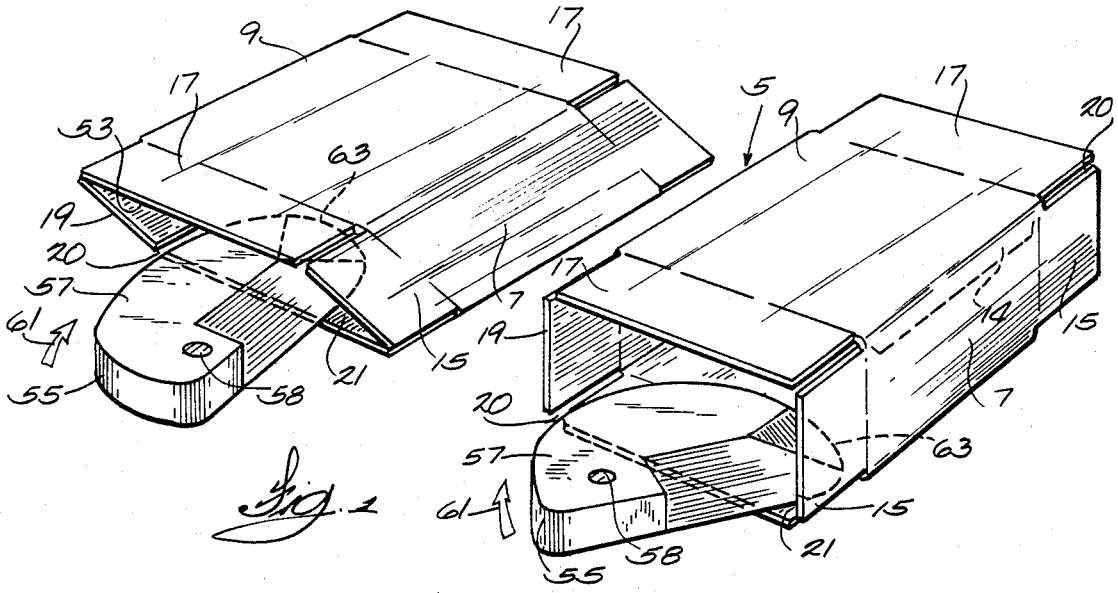
FIG. 1 is a diagrammatic perspective view of an open side carton in a partially unfolded and fully unfolded positions.
Figure 2:
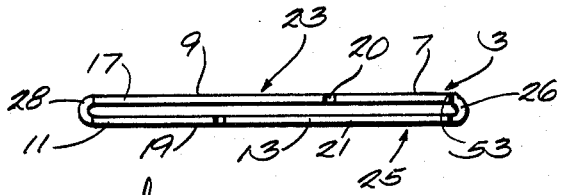
FIG. 2 is a side view of the carton of FIG. 1, but showing the carton folded into a blank.
Figure 12:
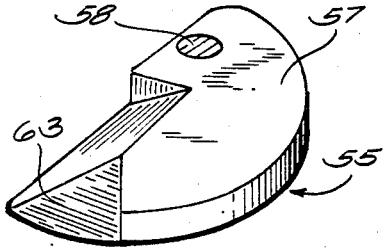
FIG. 12 is a perspective view of an expandions arm.
Figure 4:
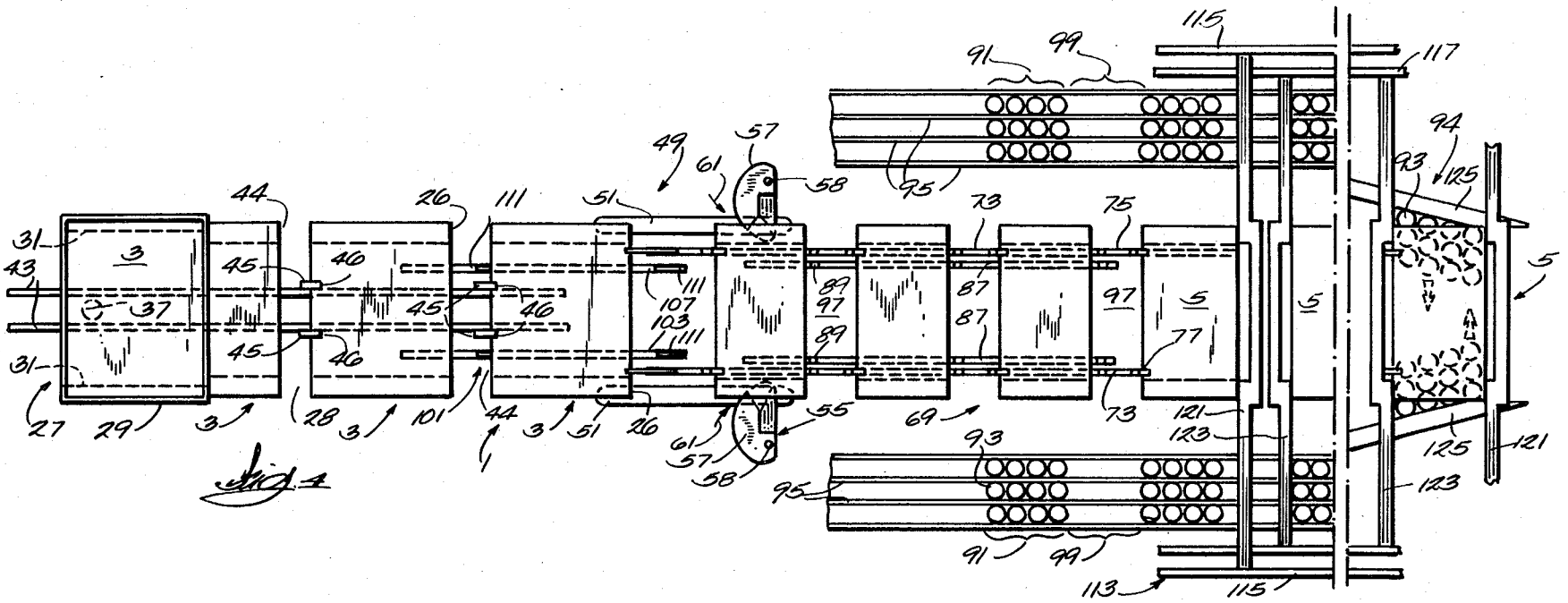
FIG. 4 is a top view of the carton unfolding apparatus of the present invention.
Figure 3:
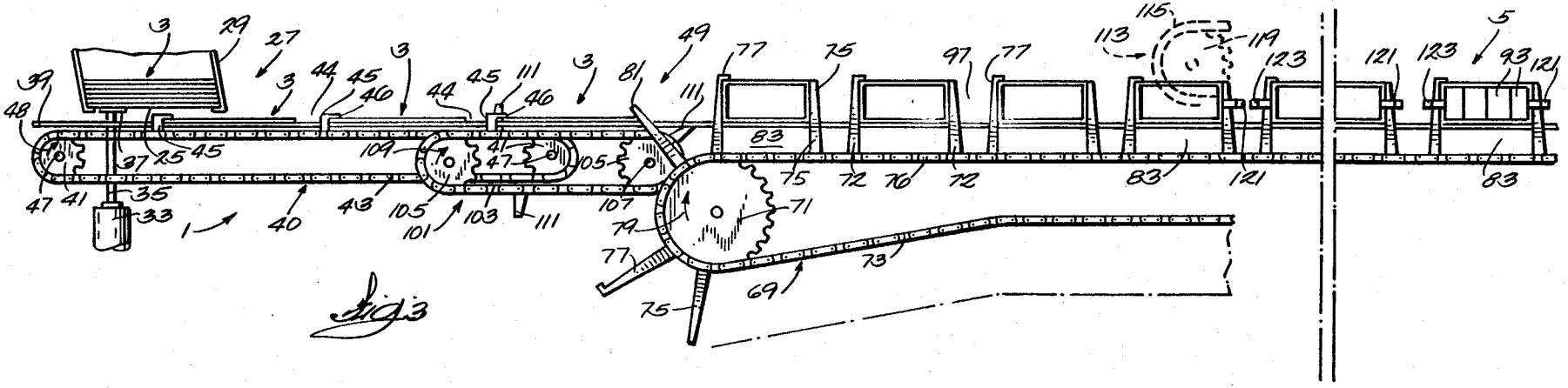
FIG. 3 is a side view of the carton unfolding apparatus of the present invention.

Referring to FIG. 1, an open side carton 5 is illustrated that is advantageously opened by the carton unfolding apparatus 1 of the present invention, which is illustrated generally in FIGS. 3 and 4 and includes the expansion arms 55 which project into the ends of the blank from both sides. In FIG. 1, the expansion arms on only one side are shown. The machine 1 is particularly useful for unfolding folded carton blanks 3, FIG. 2, into the fully opened side loading cartons 5 of FIG. 1.

Carton

The carton 5 consists of four connected panels:

Leading panel 7, top panel 9, trailing panel 11, and bottom panel 13. The top panel 9 may include a short tab 14 that overlaps and is bonded to a portion of the interior of the leading panel 7. The leading, top, trailing, and bottom panels terminate in oppositely extending flaps 15, 17, 19, and 21, respectively. Adjacent flaps are separated by slots 20.

As shown in FIG. 3, the cartons are supplied to the unfolding apparatus 1 as collapsed or folded blanks 3. Referring to FIG. 2, the blanks are folded into an upper layer 23 consisting of the leading and top panels 7 and 9, respectively, and a lower layer 25 consisting of the trailing and bottom panels 11 and 13, respectively. Each layer includes the flaps associated with the corresponding panels. The fold line between the leading and bottom panels forms the leading edge 26 of the blank as it is propelled through the unfolding machine. The fold line between the top and trailing panels is the blank trailing edge 28.

Supply Station

Turning to FIGS. 3 and 4, the unfolding apparatus 1 includes a supply station 27 at which the blanks 3 begin the unfolding process. The blanks are stored in a vertical stack in a hopper 29. The blanks may be retained in place in the hopper 29 by inwardly facing lips 31. To remove the blanks from the hopper, one or more vertically reciprocating power cylinders 33 may be employed. On the end of each cylinder piston rod 35 is a vacuum cup 37 for attaching to the center region of the bottom-most blank. Downward motion of the piston rod 35 bows the blank center region downwardly, but the edges of the blank lower layer flaps 19 and 21 remain supported by the lips 31.

Primary Conveyor

To strip the bowed blanks 3 from the hopper 29 and to propel the blanks downstream, that is, to the right in FIGS. 3 and 4, from the supply station 27, the unfolding machine 1 of the present invention includes a first or primary conveyor system 40. In the illustrated construction, the primary conveyor 40 comprises two sets of sprockets 41, around which are trained suitable chains 43. Attached to the chains 43 are a number of primary stripper lugs 45, each lug having a forwardly extending finger 46. The spacing between adjacent lugs 45 is greater than the distance between the blank leading edge 26 and trailing edge 28, thereby creating gaps 44 between successive blanks. The sprockets 41 are mounted on shafts 47 that are rotated in the direction of arrow 48 by conventional drive mechanisms, not shown. The primary conveyor system is operated in synchronization with the cylinder 33 such that lugs 45 accost the trailing edge 28 of a bowed blank and strip the blank from the hopper 29, causing the blank to fall onto two or more transversely spaced longitudinally extending horizontal rails 39. The primary conveyor lugs then propel the blank downstream from the supply station.

Accelerator Conveyor

In FIGS. 3 and 4, reference numeral 101 designates a secondary or accelerator conveyor system. Accelerator conveyor system 101 comprises a pair of chains 103 trained around sprockets 105. The accelerator conveyor system overlaps the primary conveyor system 40 for a portion of the lengths of the two conveyor systems. The sprockets 105 are mounted on shafts 107 that are driven in the direction of arrows 109 by any suitable means, not illustrated. Attached to the chains 103 are a series of secondary lugs 111.

The accelerator conveyor system 101 is operated in timed relation to the primary conveyor system 40, and the lugs 111 are spaced such that the lugs 111 enter upwardly through the gaps 44 between successive blanks 3 that are being propelled downstream by the primary conveyor lugs 45. The secondary conveyor system is operated at a faster speed than the primary conveyor system. Consequently, the lugs 111 advance in the gaps 44 relative to the lugs 45. The lugs 111 eventually catch up to the blank and take over the task of propelling the blank, accelerating them to the speed of the accelerator conveyor system. See FIGS. 5 and 6. Typically, the primary conveyor system may operate approximately 3900 inches per minute, and the accelerator conveyor system speed may be approximately 4800 inches per minute. The accelerator conveyor system then propels the blanks to the unfolding station 49, while the lugs 45 return via downstream sprocket 41 to the supply station 27.

Unfoldinq Station

At the unfolding station 49, the blanks 3 are unfolded into fully opened side loading cartons 5. In preparation for the unfolding process, the bottom flaps 21 and trailing flaps 19 are folded angularly downwardly by conventional plows 51 as the blank moves downstream. See FIGS. 4–6 and 11. With the flaps 19 and 21 restrained downwardly, the upper layer 23 is partially exposed on its undersurface 53.

Figure 5:
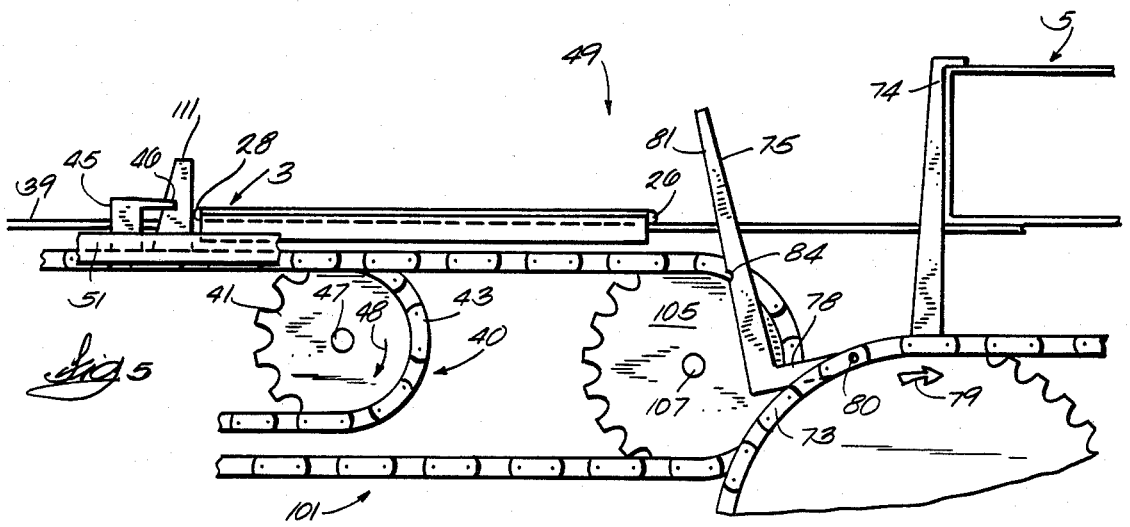
FIG. 5 is an enlarged side view of the unfolding station of the apparatus of the present invention showing a folded blank and an unfolded carton.
Figure 6:
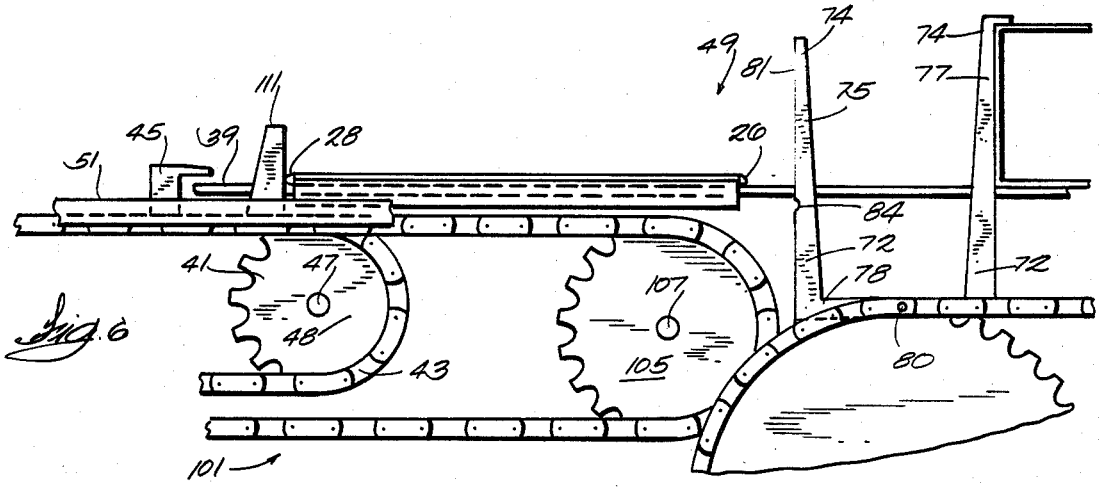
FIG. 6 is a view generally similar to FIG. 5, but showing a blank as it approaches the unfolding station.

Referring particularly to FIGS. 5 and 6, a blank 3 is shown as it arrives at the unfolding station 49. The blank trailing edge 28 is propelled by the accelerator conveyor system 111. To raise the blank upper layer 23 above the lower layer 25 at the beginning of the unfolding process, a pair of expansion arms 55 with paddles 57 are incorporated into the unfolding machine 1. See FIGS. 1, 4, 7, 11 and 12. The paddles 57 rotate together by means of shafts 58. The shafts 58 are driven by any suitable drive mechanism, not shown, in timed relation to the accelerator conveyor system 101, as will be described in detail. The two paddles rotate in synchronization with each other and in opposite directions as indicated by arrows 61. To minimize friction on the blank surfaces during the unfolding process, as will be explained, it is preferred that the paddles be manufactured from a smooth nylon reenforced plastic. Any low friction surface such as polished steel can be employed.

Figure 13:
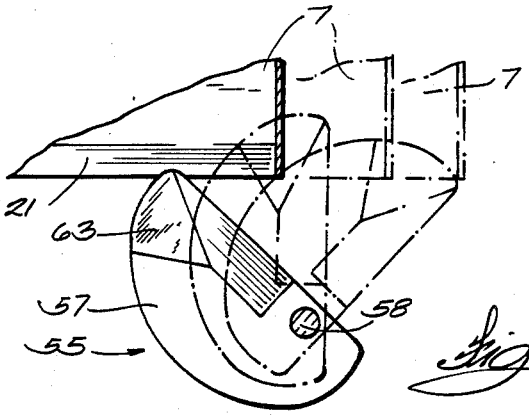
FIG. 13 is a diagrammatic view of the carton erecting process at various positions of one of the expansion arms.

As the blank 3 reaches the unfolding station 49, the paddles 57 rotate to positions such that their inclined leading tip edges 63 approach and contact the undersurface 53 of the blank upper layer 9. Simultaneously, the paddle bottom surfaces 67 slide on surface 65 of the blank lower layer 25 to thereby restrain the lower layer against the rails 39. This flattens the bottom 25 of the carton blank. As the expansion arms continue to rotate, the leading tip edges 63 lift the blank upper layer above the bottom layer, thus unfolding the blank slightly. See FIG. 1, left view, and FIG. 8. The initial raising of the upper layer above the lower layer is by the positive action of the paddle surfaces 63 and 67. Therefore, the paddles are able to force apart the two layers even if they were unintentionally partially bonded together because of stray glue being deposited on either of the surfaces 53 or 67 during blank manufacture. The initial unfolding action causes the trailing edge to rise above the rails 39 and the distance between the blank leading and trailing edges to decrease slightly. Continued motion by the expansion arms and the accelerator conveyor causes the trailing edge to rise above the lug 111, FIG. 9. As the paddles or expansion arms 55 frictionally contact the carton, they effect a pulling action on first the undersurface 53 of the top of the carton and then the inside surface of the front panel 7 as subsequently described. FIG. 13 also shows the unfolding sequence with the paddle (full line showing) entering the carton and in the intermediate position the surface 63 is contacting and elevating the top panel and in the far right position, the portion 63 is engaging the front panel 7 and pulls the carton into an erect position. As the paddles 57 contact the blank, they also flatten any upward bow in the bottom panel, thus positively levelling or squaring the panels with surfaces parallel.

Pocket Conveyor

To complete the blank unfolding process and to propel an open carton 5 downstream from the unfolding station 49, the machine 1 of the present invention includes a third or pocket conveyor system 69. In the illustrated construction, the pocket conveyor system 69 comprises conventional sprockets 71 with chains 73 trained therearound. Chains 73 have upper runs 76 that are spaced below and parallel the rails 39. The third conveyor system further includes pairs of flight bars, each pair consisting of a leading flight bar 75 and a trailing flight bar 77. The linear spacing between the foot ends 72 of a pair of flight bars along the chains is equal to the width of the carton top and bottom panels 9 and 13, respectively. As best seen in FIGS. 5 and 6, the leading flight bars 75 are preferably pivotally connected to the chains through a leg portion 78 and a pin 80. The third conveyor is driven by a suitable drive system, not shown, in the direction of arrow 79 at the same speed as the accelerator conveyor 101.

The third conveyor system 69 operates in timed relation to the second conveyor system 101 such that a blank 3 is located between a lug 111 and the back side 81 of a leading flight bar 75 when the blank reaches the unfolding station 49 and as the paddles 57 approach the blank. Consequently, the third conveyor system operates to control the blank leading edge 26.

Turning to FIGS. 7–9 and 11, the expansion arm tips 63 continue to slide on the surfaces 53 and 65 in a forwardly direction relative to the blank 3. Eventually, the tips contact the leading panel 7. From that point, the paddles push the leading panel forwardly. Since the blank leading edge is controlled by the pocket conveyor leading flight bar 75, the rotation of expansion arms against the blank leading panel causes further unfolding of the blank.

Figure 9:
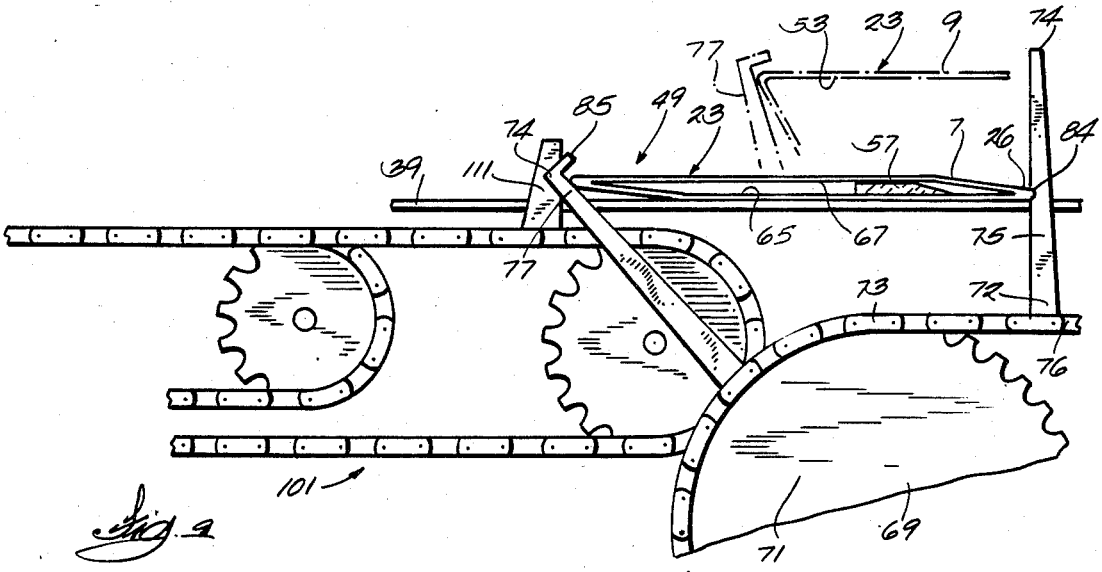
FIG. 9 is a sectional view generally similar to FIG. 8, but showing a blank in a further unfolded condition.
Figure 8:
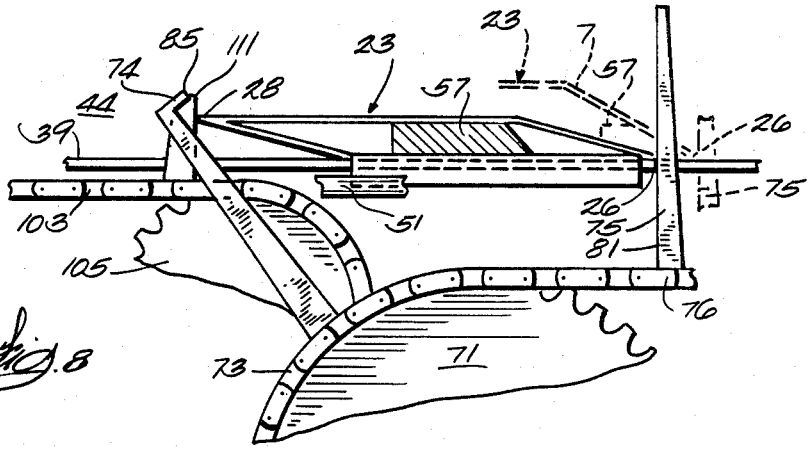
FIG. 8 is a sectional view taken along lines 8—8 of FIG. 7.
Figure 11:
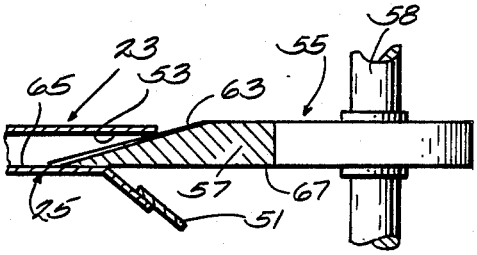
FIG. 11 is a sectional view taken along lines 11—11 of FIG. 7.
Figure 7:
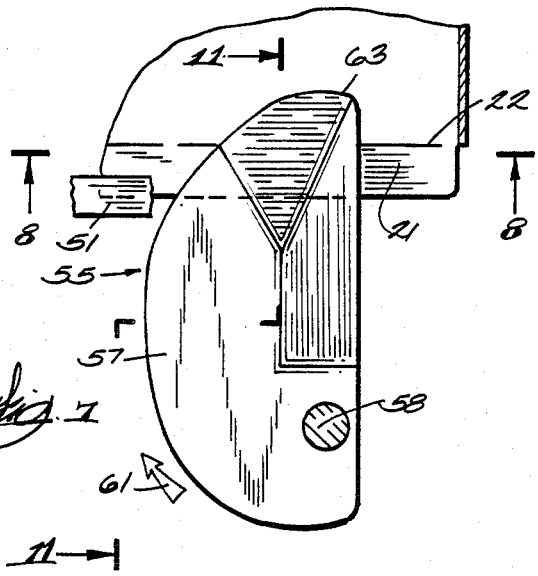
FIG. 7 is an enlarged partial top view of an expansion arm of the unfolding apparatus of the present invention.

The trailing flight bars 77 play no part in the unfolding process described thus far. As best shown in FIGS. 8 and 9, a sprocket 71 on the third conveyor system 69 is located under the unfolding station 49 such that a trailing flight bar is positioned on the side of the sprocket at the start of the unfolding cycle. As a result, the trailing flight bar lies nearly horizontally under the blank 3. Operation of the sprockets 71 bring the trailing flight bars upwardly in arcuate paths along the sprockets, such that the trailing flight bars approach a vertical attitude. The free ends 74 of the trailing flight bars travel a greater distance than the foot ends 72 for the same angle of rotation of the sprockets. Therefore, the angular velocity of the free ends 74 is greater than the velocity of the foot ends 72. The trailing flight bars are positioned relative to the corresponding leading flight bars such that the trailing flight bars enter upwardly into the gap 44 behind the blank trailing edge. With continued operation, the trailing flight bars contact the blank trailing edge just as the trailing edge rises above the secondary conveyor system lug 111. Thus, the trailing flight bars take over from the accelerator conveyor system 101 the role of propelling the blank. Because of the greater angular velocity of the trailing flight bar free ends relative to the leading flight bar foot ends, the trailing flight bars propel the blank trailing edge forwardly and upwardly with respect to the blank leading edge, thereby continuing the unfolding process. The paddle surface 67 continues to restrain the blank lower layer 25 downwardly against the rails 39. See the dashed lines in FIG. 9. Eventually, the trailing flight bars attain the nearly vertical attitude of the leading flight bars, thus completing the unfolding process. By that time, the paddles 57 have rotated out of contact with the blank lower layer 25. The pairs of vertical trailing and leading flight bars create pockets 83 having longitudinal spacings just large enough to accommodate the unfolded cartons 5. To prevent the partially opened cartons of FIG. 9 from riding up the trailing flight bar front surface, the free end of each trailing flight bar 77 may be formed with a hook 85. In addition, a rear facing notch 84 in FIGS. 5, 6 and 9 can be provided to assist in holding the front edge of the panel down during the initial erection process.

Figure 10:
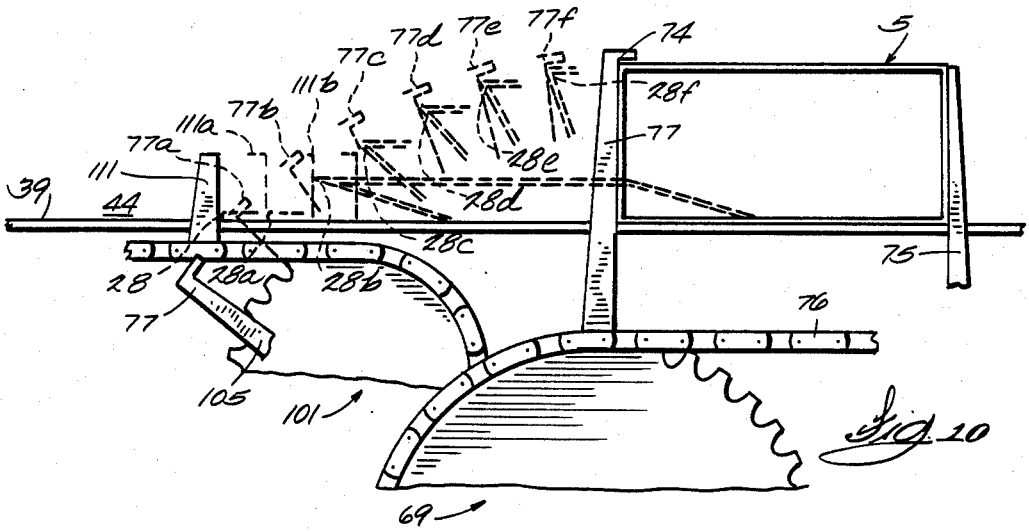
FIG. 10 is a side view generally similar to FIG. 5, but showing the sequence of steps by which the apparatus of the present invention unfolds a carton blank.

Turning to FIG. 10, the sequence of positions of some of the components of the present invention involved in the unfolding process are illustrated. The positions of lug 111*a*, trailing flight bar 77*a*, and blank trailing edge 28*a* generally correspond with the respective positions shown in FIG. 6. The positions of lug 111*b*, trailing flight bar 77*b*, and blank trailing edge 28*b* correspond with the respective positions shown in FIG. 8. The positions of lug 111*c*, trailing flight bar 77*c*, and blank trailing 28*c* generally correspond to the respective positions illustrated in FIG. 9.

Further in accordance with the present invention, the pocket conveyor system 69 may comprise two sets of substantially identical side-by-side chains and sprockets. Referring to FIG. 4, a second pair of chains 87 is shown adjacent to chains 73. The chains 87 are driven in synchronization with the chains 73 by sprockets, not shown, that are substantially identical to sprockets 71. When the second pair of chains and sprockets are used, only leading flight bars 89 are attached to the chains 87. Trailing flight bars 77 remain attached to chains 73, and the leading flight bars 75 are removed from the chains 73. The purpose of the dual chain and sprocket arrangement is to facilitate machine changeover to handle different size cartons 5. The chains 87 need be only displaced on their sprockets the desired amount relative to the chain 73 to create different sized pockets 83 for different size cartons. It will be appreciated that the chains 87 may carry the trailing flight bars and the chain 73 would then carry the leading flight bars.

The positive opening action provided by the rotating paddles 57 enable blanks with partially glued inner surfaces 53 and 65 to be readily opened. A further advantage of the unfolding apparatus 1 of the present invention is that it can accommodate blanks that are defective because of inconsistent sized slots 20, FIG. 1.

After the carton 5 has been fully unfolded, it is propelled downstream by the third conveyor system 69 for filling and closing.

Loadinq Station

Returning to FIG. 4, complements 91 of upright articles 93 are shown being loaded into the sides of the open carton 5 at a loading station 94. The articles 93 are grouped into complements 91 of the desired number by conventional grouper apparatus, not shown. The rows of articles in the complements are guided and separated by longitudinally extending upstanding plates 95. To push the complements downstream, a pusher bar system 113 is employed. Also see FIG. 3. In the preferred embodiment, the pusher bar system 113 comprises two pairs of chains 115 and 117, together with appropriate sprockets such as sprocket 119. The chains 115 and 117 and their respective sprockets straddle the complements of articles as they are fed to the loading station 94. Extending between the chains 115 is a leading pusher bar 121. Extending between the chains 117 is a trailing pusher bar 123. The pusher system is operated at the same speed as the pocket conveyor system 69, and the pusher bars 121 and 123 are positioned such that they descend together around the sprockets to enter the spacing 97 between successive cartons and also the spacing 99 between successive complements of articles. The complements are thereby captured between the pusher bars for being pushed downstream. The double chain arrangement for the chains 115 and 117 permit easy changeover for handling different size cartons. However, it will be understood that the pusher system may employ a single pair of chains bearing both the leading and trailing pusher bars, if desired.

To load the complements 91 into an unfolded carton 5, the unfolding apparatus 1 of the present invention includes a pair of inwardly angled guides 125. The guides 125 force the complements into the carton as the pusher bars 123 push the complements downstream in synchronization with the carton. After being loaded at the loading station, the cartons continue to be propelled downstream by the trailing flight bars 77. Subsequently, the carton flaps are closed and sealed by known machinery.

Thus, it is apparent that there has been provided, in accordance with the invention, a carton opening apparatus that fully satisfies the aims and advantages set forth above. While the invention has been described in conjunction with specific embodiments thereof, it is evident that many alternatives, modifications, and variations will be apparent to those skilled in the art. Accordingly, it is intended to embrace all such alternatives, modifications, and variations as fall within the spirit and broad scope of the appended claims.

I claim:

1. Apparatus for opening folded open side cartons, the cartons being folded into blanks having leading and trailing edges and an upper layer having leading and top panels and a lower layer in facing contact with the upper panels and having trailing and bottom panels, each panel having a pair of oppositely extending flaps comprising:

a. horizontal rail means for supporting the lower layer panels of the folded blanks during longitudinal motion thereof downstream along an unfolding path;

b. storage means for storing a supply of folded blanks;

c. first conveyor means for propelling the blanks downstream along the horizontal rail means from the storage means at a first speed;

d. second conveyor means for accelerating the blanks to propel them downstream to an unfolding station at a second speed greater than the first conveyor means speed;

e. plow means at the unfolding station for restraining the blank lower layer flaps in an angular downward attitude;

f. expansion arm means at the unfolding station for positively restraining the blank bottom panel against the rail means and for simultaneously lifting the blank upper layer upwardly above the rail means and upwardly relative to the restrained lower layer; and g. third conveyor means downstream from the unfolding station operated in timed relation to the second conveyor means and to the expansion arm means for cooperating with the expansion arm means to unfold the blank at the unfolding station and for propelling open cartons downstream from the unfolding station.

2. The apparatus of claim 1 wherein the first conveyor means comprises:

a. at least one endless chain having a longitudinal upper run spaced below and parallel to the rail means;

b. at least one lug joined to the chain and adapted to propel the blank downstream; and c. pull means for downwardly bowing a portion of the lower most blank within the storage means in synchronization with the movement of the first conveyor means to position the blank in the path of the first conveyor means lugs to thereby enable the lugs to accost the bowed blank trailing edge and strip the blank from the storage means.

3. Apparatus for opening folded open side cartons, the cartons being folded into blanks having leading and trailing edges and an upper layer having leading and top panels and a lower layer in facing contact with the upper panels and having trailing and bottom panels, each panel having a pair of oppositely extending flaps comprising:

a. horizontal rail means for supporting the folded blanks during longitudinal motion thereof downstream along an unfolding path;

b. storage means for storing a supply of folded blanks;

c. first conveyor means for propelling the blanks downstream along the horizontal rail means from the storage means at a first speed;

d. second conveyor means for accelerating the blanks to propel them downstream to an unfolding station at a second speed greater than the first conveyor means speed;

e. plow means at the unfolding station for restraining the blank lower layer flaps in an angular downward attitude;

f. expansion arm means at the unfolding station for restraining the blank bottom panel against the rail means and for lifting the blank upper layer relative to the lower layer, wherein the expansion arm means comprises:

i. a pair of shafts mounted for rotation on opposite sides of the rail means, each shaft having a vertical axis; and ii. a paddle extending from each shaft to rotate in a horizontal plane, each paddle having a bottom surface adapted to restrain the blank lower layer downwardly against the rail mcans during a portion of each paddle revolution and an inclined tip edge adapted to penetrate the blank between the upper and lower layers and to lift the upper layer upwardly relative to the restrained lower layer during a portion of each paddle revolution to thereby partially unfold the blank; and g. third conveyor means downstream from the unfolding station operated in timed relation to the second conveyor means and to the expansion arm means for cooperating with the expansion arm means to unfold the blank at the unfolding station and for propelling open cartons downstream from the unfolding station.

4. The apparatus of claim 3 wherein the paddles rotate at an angular velocity that imparts a paddle tip peripheral speed greater than the longitudinal speed of the blank along the rail means, and wherein the paddle tips slide forwardly inside the blank and subsequently contact the blank leading panel during a portion of each paddle revolution to assist opening the blank.

5. Apparatus for opening folded open side cartons, the cartons being folded into blanks having leading and trailing edges and an upper layer having leading and top panels and a lower layer in facing contact with the upper panels and having trailing and bottom panels, each panel having a pair of oppositely extending flaps comprising:

a. horizontal rail means for supporting the folded blanks during longitudinal motion thereof downstream along an unfolding path;

b. storage means for storing a supply of folded blanks;

c. first conveyor means for propelling the blanks downstream along the horizontal rail means from the storage means at a first speed;

d. second conveyor means for accelerating the blanks to propel them downstream to an unfolding station at a second speed greater than the first conveyor means speed;

e. plow means at the unfolding station for restraining the blank lower layer flaps in an angular downward attitude;

f. expansion arm means at the unfolding station for restraining the blank bottom panel against the rail means and for lifting the blank upper layer relative to the lower layer;

g. third conveyor means downstream from the unfolding station operated in timed relation to the second conveyor means and to the expansion arm means for cooperating with the expansion arm means to unfold the blank at the unfolding station and for propelling open cartons downstream from the unfolding station; and h. pusher means located downstream from the unfolding station for pushing complements of upright articles downstream in synchronization with an open carton and for simultaneously side loading the articles into the open sides of the unfolded cartons, the pusher means comprising:

i. pusher chain and sprocket means straddling the third conveyor means for propelling the pusher bar means downstream in synchronization with the cartons propelled by the third conveyor means, wherein the pusher chain and sprocket means comprise a pair of first pusher chains and associated sprockets that straddle the third conveyor means and a pair of second pusher chains and sprockets that straddle the pair of first chains and sprockets;

ii. pusher bar means for capturing the complements of articles, wherein the pusher bars comprise a first pusher bar attached to and extending between the pair of first pusher chains, and a second pusher bar attached to and extending between the pair of second pusher chains, the first and second pusher bars being spaced longitudinally with respect to each other to capture therebetween a complement of articles; and iii. guide means for directing the complements transversely inwardly as they are being propelled downstream by the pusher bar means, so that the articles enter the open side carton as the complements of articles are pushed downstream by the pusher bar means.

6. A method of unfolding open side cartons folded into blanks having leading and trailing edges and having an upper layer composed of the carton top and leading panels and a lower layer composed of the carton bottom and trailing panels, each panel terminating in oppositely extending flaps, comprising the steps of:

a. propelling a blank in a downstream direction along horizontal supports at a first predetermined speed;

b. folding the blank lower layer flaps angularly downwardly;

c. positively restraining the bottom panel downwardly against the horizontal supports;

d. controlling the blank leading edge against uncontrolled downstream motion;

e. lifting the blank top panel slightly upwardly above the bottom panel and horizontal supports to partially open the blank;

f. propelling the partially open blank leading panel in a downstream direction relative to the horizontally restrained blank bottom panel to further open the blank; and g. propelling the trailing edge of the partially open blank toward the controlled leading edge thereof to completely open the carton.

7. The method of claim 6 comprising the further steps of:

a. horizontally stripping a blank from a supply thereof and propelling the blank downstream from the supply at a second predetermined speed less than the first predetermined speed; and b. accelerating the blanks from the second speed to the first speed.

8. A method of unfolding open side cartons folded into blanks having leading and trailing edges and having an upper layer composed of the carton top and leading panels and a lower layer composed of the carton bottom and trailing panels, each panel terminating in oppositely extending flaps, comprising the steps of:

a. propelling a blank in a downstream direction along horizontal supports at a first predetermined speed;

b. folding the blank lower layer flaps angularly downwardly;

c. restraining the bottom panel downwardly against the horizontal supports;

d. controlling the blank leading edge against uncontrolled downstream motion;

e. lifting the blank top panel slightly to partially open the blank, comprising the steps of:

i. providing a pair of paddles mounted for rotation in horizontal planes; and ii. rotating the paddles to penetrate the blank between the upper and lower layers and to lift the blank top panel during a portion of each revolution of the paddles;

f. propelling the partially open blank leading panel in a downstream direction relative to the blank leading edge to further open the blank; and g. propelling the trailing edge of the partially open blank toward the leading edge thereof to completely open the carton.

9. The method of claim 8 wherein the step of pushing the partially open blank leading panel comprises the step of rotating the paddles into contact with the blank leading panel during a portion of each revolution of the paddles.

10. Apparatus for opening folded open side cartons, the cartons being folded into blanks having leading and trailing edges and an upper layer having leading and top panels and a lower layer in facing contact with the upper panels and having trailing and bottom panels, each panel having a pair of oppositely extending flaps comprising:

a. horizontal rail means for supporting the folded blanks during longitudinal motion thereof downstream along an unfolding path;

b. storage means for storing a supply of folded blanks;

c. first conveyor means for propelling the blanks downstream along the horizontal rail means from the storage means at a first speed, wherein the first conveyor means comprises:

i. at least one endless chain having a longitudinal upper run spaced below and parallel to the rail means; and ii. at least one lug joined to the chain and adapted to contact a stored blank trailing edge to strip the blank from the storage means and to propel the blank downstream;

d. second conveyor means for accelerating the blanks to propel them downstream to an unfolding station at a second speed greater than the first conveyor means speed;

e. plow means at the unfolding station for restraining the blank lower layer flaps in an angular downward attitude;

f. expansion arm means at the unfolding station for restraining the blank bottom panel against the rail means and for lifting the blank upper layer relative to the lower layer, wherein the expansion arm means comprises:

i. a pair of shafts mounted for rotation on opposite sides of the rail means at the unfolding station, the shafts having vertical axes; and ii. a paddle mounted to each shaft to rotate therewith in a horizontal plane, each paddle having a bottom surface for restraining the blank bottom panel against the rail means during a portion of each revolution of the shaft, each paddle having an inclined tip edge for sequentially contacting the blank top panel to lift it above the blank lower panel and contacting the blank leading panel to push it forwardly with respect to the bottom panel to thereby further unfold the blank during a portion of each revolution of the shafts; and g. third conveyor means downstream from the unfolding station operated in timed relation to the second conveyor means and to the expansion arm means for cooperating with the expansion arm means to unfold the blank at the unfolding station and for propelling open cartons downstream from the unfolding station.

11. The apparatus of claim 4 wherein the third conveyor means comprises:

a. at least one chain having an upper run below and parallel to the rail means;

b. sprocket means for guiding and driving the chain at the same speed as the second conveyor means, the sprocket means including at least one sprocket located under the unfolding station;

c. at least one leading flight bar having a free end and a foot end attached to the chain, the leading flight bar projecting vertically upwardly from the chain upper run and spaced downstream from an operatively associated lug on the second conveyor means a distance slightly greater than the distance between a blank leading edge and trailing edged when the second conveyor means lug has propelled the blank to the unfolding station; and d. at least one trailing flight bar having a free end and a foot end attached to the chain, the distance between the trailing and leading flight bar foot ends being slightly greater than the width of the carton, and trailing flight bar being positioned on the chain over the side of the sprocket in an angular attitude under the blank when the second conveyor means lug has propelled the blank to the unfolding station.

12. The apparatus of claim 11 wherein the trailing flight bar contacts the blank trailing edge after the expansion arm means has rotated out of contact with the blank lower layer, so that opening the blank is transferred from the expansion arm means to the trailing flight bar.

13. A method of unfolding open side cartons folded into blanks having leading and trailing edges and having an upper lalyer composed of the carton top and leading panels and a lower layer composed of the carton bottom and trailing panels, each panel terminating in oppositely extending flaps, comprising the steps of:

a. propelling a blank in a downstream direction along horizontal supports at a first predetermined speed;

b. folding the blank lower layer flaps angularly downwardly;

c. restraining the bottom panel downwardly against the horizontal supports comprising the steps of:

i. providing a pair of paddles mounted for rotation in horizontal planes on opposite sides of the horizontal supports, the paddles having bottom surfaces approximately in line with the blank lower layer; and ii. rotating the paddles to penetrate the blank between the upper and lower layers thereof so that the paddle bottom surface slides over and downwardly restrains the blank lower layer during a portion of each revolution of the paddles;

d. controlling the blank leading edge against uncontrolled downstream motion;

e. lifting the blank top panel slightly to partially open the blank;

f. propelling the partially open blank leading panel in a downstream direction relative to the blank leading edge to further open the blank; and g. propelling the trailing edge of the partially open blank toward the leading edge thereof to completely open the carton.

14. Apparatus for opening folded open side cartons, the cartons being folded into blanks having leading and trailing edges and an upper layer having leading and top panels and a lower layer in facing contact with the upper panels and having trailing and bottom panels, each panel having a pair of oppositely extending flaps comprising:

a. horizontal rail means for supporting the folded blanks during longitudinal motion thereof downstream along an unfolding path;

b. storage means for storing a supply of folded blanks;

c. first conveyor means for propelling the blanks downstream along the horizontal rail means from the storage means at a first speed;

d. plow means at the unfolding station for restraining the blank lower layer flaps in an angular downward attitude;

e. expansion arm means at the unfolding station, said arm means restraining the blank bottom panel against the rail means, lifting the blank upper layer relative to the lower layer, and pressing against the leading panel while the lower panel is restrained to cause a pulling action on the trailing panel using the upper panel as a pulling link; and f. third conveyor means downstream from the unfolding station operated in timed relation to the expansion arm means for cooperating with the expansion arm means to unfold the blank at the unfolding station and for propelling open cartons downstream from the unfolding station.

* * * * *